US005216319A

United States Patent [19]

Van Heeswijk

[11] Patent Number: 5,216,319

[45] Date of Patent: Jun. 1, 1993

[54] CAPPED HIGH-PRESSURE DISCHARGE LAMP

[75] Inventor: Johannes A. A. M. Van Heeswijk, Eindhoven, Netherlands

[73] Assignee: U.S. Philips Corporation, New York, N.Y.

[21] Appl. No.: 676,928

[22] Filed: Mar. 28, 1991

[30] Foreign Application Priority Data

Sep. 26, 1990 [NL] Netherlands ..... 9002096

[51] Int. Cl.[5] ..... H01J 5/50

[52] U.S. Cl. ..... 313/318; 313/51

[58] Field of Search ..... 313/318, 623, 51, 113; 362/296, 297

[56] References Cited

U.S. PATENT DOCUMENTS 4,804,878 2/1989 Hough et al. ..... 313/318
4,868,456 9/1989 Sanders et al. ..... 313/318
5,036,439 7/1991 Hoffman et al. ..... 313/318

FOREIGN PATENT DOCUMENTS 0321866 6/1989 European Pat. Off. .
1588528 4/1981 United Kingdom .

*Primary Examiner*—Donald J. Yusko
*Assistant Examiner*—Michael Horabik
*Attorney, Agent, or Firm*—Paul R. Miller

[57] ABSTRACT

The HID lamp, suitable for use as a vehicle headlamp, includes a lamp cap having a first, central recess, a second, annular recess surrounding the central recess, and a third recess separated from the first and second recesses. The recesses accommodate a first end of the discharge vessel and a first current supply conductor, a fixation member, and second current supply conductor, respectively. The fixation member is frictionally fixed in the annular recess by resilient tongues and is welded to a clamping member holding a sealed end of the discharge vessel. The lamp construction allows for adjustably mounting the discharge vessel to the lamp cap and avoids harmful and disadvantageous electrical high-voltage and high-frequency effects through electrical isolation of the clamping and fixation members.

27 Claims, 2 Drawing Sheets

CAPPED HIGH-PRESSURE DISCHARGE LAMP

BACKGROUND OF THE INVENTION

The invention relates to a capped high-pressure discharge lamp comprising discharge vessel having a first and a second neck-shaped portions facing one another and having seals through which respective first and second current supply conductors are passed to a pair of electrodes positioned in the discharge vessel, a metal clamping member which clamps around the first neck-shaped portion of the discharge vessel, a metal fixation member provided with first tongues which are connected to the clamping member and with second tongues having free ends, a lamp cap of insulating material connected to the discharge vessel, which lamp cap at a side facing the discharge vessel has a first, circumferential cavity in which the fixation member is secured and a second, central cavity in which the first neck-shaped portion is accommodated, which central cavity affords access to a side of the lamp cap facing away from the discharge vessel, where the lamp cap carries a first and a second contact member to which the first and second current supply conductors, respectively, are connected.

Such a lamp is known from EP-0 309 041 A, which corresponds to U.S. Pat. No. 4,868,456, and is designed for use as a vehicle headlamp.

In order to be able to ignite such a lamp while it is still hot, use is made not only of a high voltage of several kV, but also of a high frequency of several kHz.

The lamp renders it possible to use a lantern, or reflector, of very small height, for example 5 cm, owing to its high brightness. In order to be accommodated therein, however, the lamp must be of compact construction.

In the known lamp, the clamping member is connected to the fixation member by means of a bush. The clamping member, the bush and the fixation member are necessary in that case for fixing the discharge vessel in the lamp cap in a position in which the pair of electrodes is aligned relative to reference locations at the lamp cap. During alignment the discharge vessel can be shifted, tilted, and rotated, as required.

Constructional parts of the lamp are under electrical tension and even pass current. The fixation member is included in the current circuit through the lamp, and the bush and the clamping member are connected to it.

It has been found that the compact construction of the lamp and the high applied voltages with their high frequencies can cause harmful and disadvantageous electrical effects, such as corona discharges, owing to which the voltage across the lamp can drop and lamp materials can be attacked. Breakdown may take place in the course of time as a result. These effects do not occur at low frequencies, for example below 100 Hz, under otherwise equal circumstances as regards to voltage and geometry.

SUMMARY OF THE INVENTION

The invention has for its object to provide a capped high-pressure discharge lamp of the kind described in the opening paragraph which is of a simple and reliable construction.

According to the invention, this object is achieved in that the lamp cap at its side facing the discharge vessel has a third cavity with access to the side facing away from the discharge vessel, which cavity is separated from the first and the second cavity and through which a connection conductor is passed which runs from the second contact member along the discharge vessel to the second current supply conductor, which connection conductor is surrounded alongside the discharge vessel by an insulator extending into the third cavity and in that;

the second tongues of the fixation member face the discharge vessel and lie with their free ends in the first cavity with clamping fit, the first tongues being welded to the clamping member.

In the lamp according to the invention, the clamping member and the fixation member are not electrically live, i.e. do not carry electric current, during lamp operation. The first current supply conductor on the one hand and the second current supply conductor and the associated connection conductor on the other hand are spatially separated and screened from one another. The lamp is of a simple construction. Fewer metal parts are necessary for its assembly, while nevertheless a good alignment of the pair of electrodes is possible. The lamp is reliable and is capable of forming a passing beam or driving beam, depending on the nature of the lantern, or reflector, in which it is used.

A very attractive characteristic of the lamp according to the invention is the simplicity of its construction and the ease with which it can be assembled, especially with regard to the fixation member. This member may be manufactured from resilient metal tape, for example spring steel. The fixation member may simply be pressed into the first cavity of the lamp cap, where it fixes itself by means of its second tongues which lie against the boundary of the cavity with their free ends and anchor themselves therein in the manner of barbed hooks.

The fixation member can be very compact if the second tongues are bent back alongside the fixation member.

In a favourable embodiment, the cavity is formed so as to restrict rotation of the fixation member in the cavity. This may be realized, for example, in that the cavity has projections which point inwards and between which a second tongue is enclosed. Alternatively, the fixation member may have a third tongue which is enclosed in a recess in the cavity.

This embodiment is of particular importance since the position of the first tongues during assembly of the lamp is thereby determined, which renders it easier to provide the clamping member with attachments.

In a favourable modification of the embodiment described, a depth stop for the fixation member is present between the second tongues. This stop also contributes to an accurate position of the first tongues. The depth stop may comprise one or several elevations in the first cavity. It is favourable, however, for the fixation member itself to have one or several tongues which abut in the cavity.

The clamping member may be a split sleeve which is provided around the first neck-shaped portion of the lamp in a stretched-out, or tensioned condition. Alternatively, a sleeve consisting of two parts may be joined into a whole while keeping the neck-shaped portion clamped therebetween.

In view of the comparatively high operating temperature of the clamping member and the comparatively great differences in coefficient of expansion between a metal and glass having a high $SiO_2$ content of, for example, 95% by weight or more, such as, for example, quartz glass, it is useful to use a clamping member having a resilient portion. The result of this is that a clamping force is exerted on the discharge vessel also under operating conditions.

Very favourable for that purpose is a clamping member which is tubular and which has sideways extending tags forming part of a first and a second circumference portion and welded together, and opposite these a hairpin-shaped, laterally projecting resilient connection portion. Before being welded together, the tags facilitate the application of the clamping member; the hairpin-shaped connection portion also provides clamping force at elevated temperature. The clamping member may easily be manufactured from sheet material, for example, spring steel.

A modification of this embodiment of the clamping member is particularly favourable. In this case each of the two ends of the tubular member carries a pair of tags and a hairpin-shaped connection portion is present at each of the two ends. This modification provides the clamping member with a very stable position and also affords the possibility of making connections with the fixation member around substantially the entire circumference in the zone between the ends of the tube.

The contact members at the lamp cap may be formed as, for example, pins, strips, bushes, etc. in order to cooperate with a connector which is connected to a supply source. It is favourable, however, if an insulated cable is fastened with electrical conduction to each of the contact members, which cables issue from a cover fastened to the lamp cap to the exterior. Detachable electrical connections can thus be moved to the supply source. This renders it possible to position them farther apart than is possible at the lamp cap.

The space inside the cap may be filled with a synthetic material, for example, with silicone resin.

In a favourable embodiment, the lamp cap carries a screen cap at the side facing the discharge vessel. The screen cap may become narrower towards the discharge vessel, for example stepwise or tapering, if this should be necessary to remain outside the beam of light rays generated by the lamp and travelling to a headlight reflector. The screen cap, for example made of ceramic material such as steatite, screens the lamp cap at least substantially from the radiation generated by the lamp, such as UV, IR and visible radiation.

The lamp cap may consist, for example, of a synthetic resin, for example a thermoplastic synthetic resin, such as polyether imide, polyether sulphon, polyphenylene sulphide, polyether etherketone, polypropylene oxide, polyamide imide, polyimide, polybutylene terephthalate, which may be filled with powdery or fibrous substances such as, for example, glass or chalk.

BRIEF DESCRIPTION OF THE DRAWINGS

An embodiment of the lamp according to the invention is shown in the drawings, in which.

DESCRIPTION OF THE PREFERRED EMBODIMENTS

Figure 1:
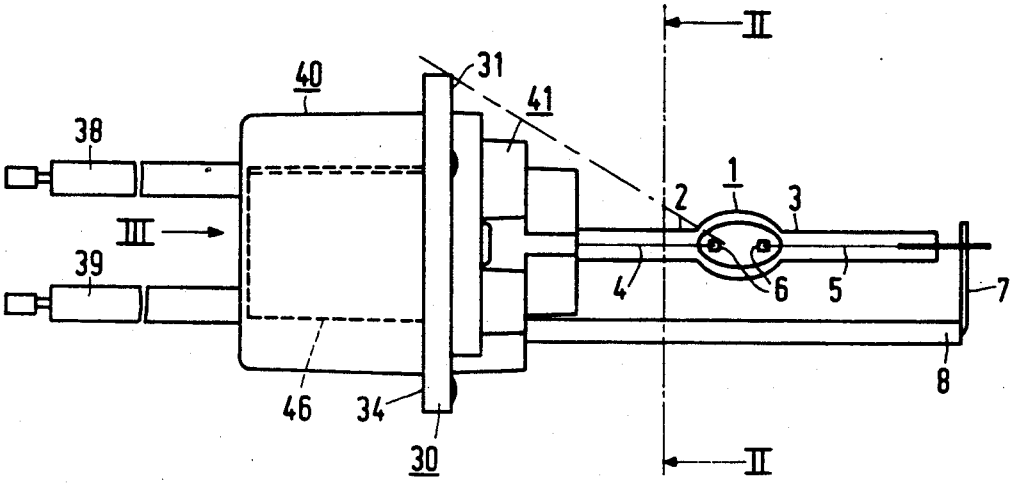
FIG. 1 is a lateral elevation.

In FIG. 1, the capped high-pressure discharge lamp comprises a discharge vessel 1 with opposing first and second neck-shaped portions 2 and 3, respectively, with seals. A first 4 and a second 5 current supply, conductor, respectively, are passed through the neck-shaped seal portions to a pair of electrodes 6 arranged in the discharge vessel.

A metal clamping member 10 (see FIG. 4) is arranged with clamping fit around the first neck-shaped portion 2 of the discharge vessel 1.

A metal fixation member 20 (see FIG. 4) provided with first tongues 21 and second tongues 22 having free ends 23 is connected to the clamping member 10.

The lamp has a lamp cap 30 of insulating material which is connected to the discharge vessel 1.

At its side 31 (see FIG. 2) facing the discharge vessel, the lamp cap has a first, circumferential cavity 32 in which the fixation member 20 is fixed, and a second, central cavity 33 in which the first neck-shaped portion 2 is accommodated, which central cavity affords access to a side 34 of the lamp cap 30 facing away from the discharge vessel 1, where the lamp cap carries a first 35 and a second 36 contact member to which the first 4 and second 5 current supply conductors, respectively, are connected.

At its side 31 facing the discharge vessel, the lamp cap 30 has a third cavity 37, in the form of a bore, with access to the side 34 facing away from the discharge vessel, separated from the first 32 and the second 33 cavity.

A connection conductor 7, which runs from the second contact member 36 to the second current supply conductor 5, is passed through said third cavity 37. Alongside the discharge vessel 1, this conductor 7 is surrounded by an insulator body 8, for example of $Al_2O_3$ or steatite, which enters the third cavity 37. Alternatively, the conductor 7 may be coated with an insulator, for example with a layer of $ZrO_2$ or $Al_2O_3$.

The fixation member 20 has second tongues 22 with free ends 23 which face the discharge vessel 1 and which rest with clamping fit in the first cavity 32 with their free ends 23. The first tongues 21 are welded to the clamping member 10. In the embodiment shown, the tongues 22 are bent back alongside the fixation member 20.

Insulated cables 38, 99 are connected to the contact members 35, 36 (FIG. 3), respectively, of the lamp cap 30 in an electrically conducting manner.

The cables 38, 39 issue to the exterior from a cover 40 fastened to the lamp cap 30 and made of, for example, polyether imide, which cover is filled with a synthetic resin, for example silicone resin. A screening cap 41, made of, for example, glass filled with mica, is present at the side 31 of the lamp cap 30 facing the discharge vessel 1. As is shown with a broken line starting from the pair of electrodes 6, this stepped cap is substantially outside the path of the beams to the reflector, i.e. to outside the lamp cap 31 in which the lamp can be placed.

Figure 2:
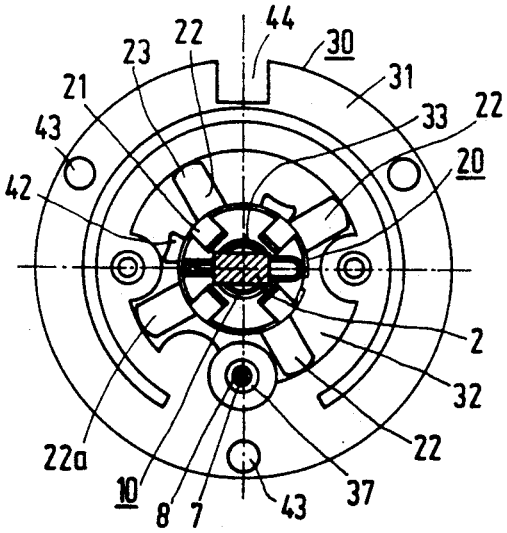
FIG. 2 is a cross-section taken on the line II—II in FIG. 1 with screen cap 41 removed.

In FIG. 2, the fixation member 20 is visible in the first, circumferential cavity 32 of the lamp cap 30, with the free ends 23 of its second tongues 22 in the first, circumferential cavity 32. The cavity is formed so as to restrict rotation of the fixation member 20. In the Figure, the tongue 22*a* has little space for rotation of the fixation member. The first cavity 32 has a recess 42 in which a third tongue 24 (see FIG. 4) present at the fixation member is enclosed. The recess 42 has radial boundaries. During, mounting of the fixation member in the lamp cap, the fixation member has a comparatively great diameter. As a result, the third tongue is comparatively far from the center of the lamp cap, at an area where the recess is comparatively wide and where it can easily accommodate the third tongue. As the fixation member is pressed further into the cavity, the clamping force of the second tongues increases, the fixation member is reduced in diameter, the third tongue moves into a narrower portion of the recess, and the rotational position of the fixation member is determined with growing accuracy.

Reference locations 43 and a recess 44 serving as a rotation lock determine the position of the lamp in a reflector of a vehicle headlight. The pair of electrodes 6 (FIG. 1) is aligned relative thereto.

The separate third cavity 37 extends to several mm above the recess 44. The connection conductor 7 is included therein with its insulation 8.

Figure 3:
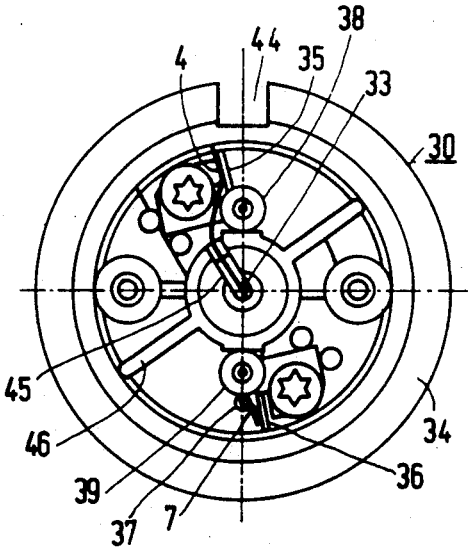
FIG. 3 is an elevation along III in FIG. 1 with cover 40 removed.

The central cavity 33 in FIG. 3 issues high above the recess 44 at the side 34 of the lamp cap 30 facing away from the discharge vessel 1. The first current supply conductor 4 is passed through a slot 45 sideways towards the first contact member 35. A partition wall 46 spatially increases the distance between the contact members 35, 36.

Figure 4:
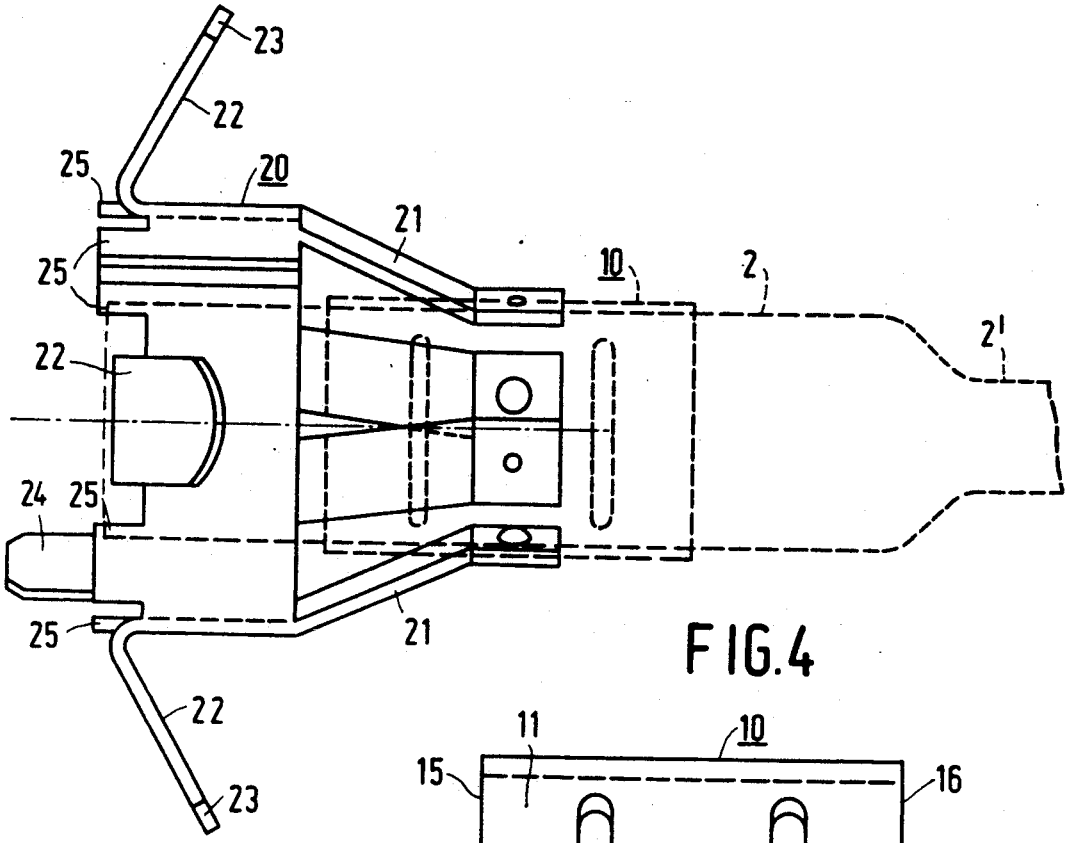
FIG. 4 is the fixation member of the lamp of FIG. 1 in lateral elevation.

It is evident from FIG. 4 that a depth stop for the fixation member 20 is present in the first cavity 32 of the lamp cap 30 of FIG. 1. The fixation member 20 has at least one tag 25 situated between two of the second tongues 22 and abutting in the cavity 32. In the Figure, such a tag 25 is present between every two second tongues 22. The third tongue 24 restricts the rotation possibility of the member. The clamping member 10 and the first neck-shaped portion 2 with seal 2' of the discharge vessel 1 are indicated diagrammatically.

The first tongues 21 lie substantially completely outside the first cavity 32 so as to be accessible for making welded joints at the clamping member 10.

Figure 5:
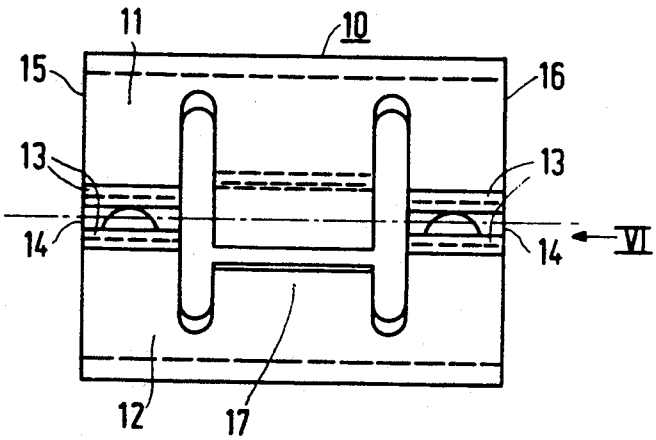
FIG. 5 is the clamping member of the lamp of FIG. 1 in lateral elevation.
Figure 6:
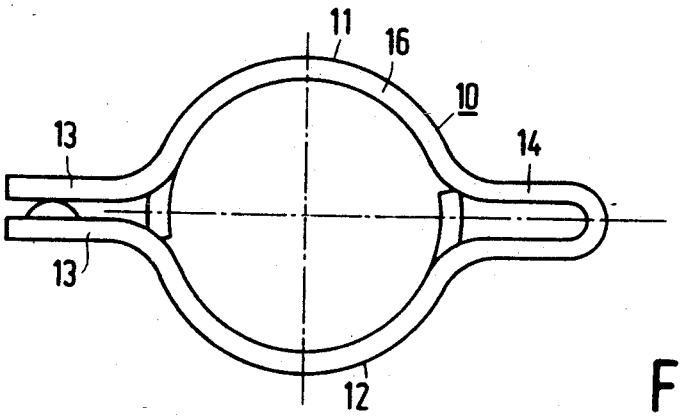
FIG. 6 is the clamping member of FIG. 5 viewed along VI.

The clamping member 10 of FIGS. 5 and 6 is tubular with tags 13 which extend sideways and are welded together in the finished lamp, which tags are present at a first and a second circumference portion 11 and 12, respectively. Opposite these tags 13, the member has a hairpin-shaped, or U-shaped, connection portion 14 which projects laterally. In the drawing, the tube has such tags 13 and such a connection portion 14 at each of its two ends 15, 16. Between its ends 15, 16, the clamping member has a sector 17 with a cylindrical surface substantially all around.

I claim:

1. A capped high-pressure discharge lamp comprising a discharge vessel having first and second opposing elongate sealed end portions through which respective first and second current supply conductors extend to a pair of electrodes positioned in the discharge vessel, a metal clamping member which clamps around said first sealed end portion of said discharge vessel, a metal fixation member including first tongues connected to said clamping member and second tongues having free ends, a lamp cap of insulating material connected to said discharge vessel, said lamp cap at a side facing said discharge vessel having a first, annular cavity in which said fixation member is secured and a second, central cavity into which said first sealed end portion extends, said first, annular cavity and said second, central cavity being separated by a cylindrical wall of said cap and said annular cavity having an outer wall, said central cavity having a portion extending to a remote side of said lamp cap facing away from said discharge vessel, and first and a second lamp cap contacts at said remote side to which said first and second current supply conductors, respectively, are connected;

characterized in that:

said lamp cap at its side facing said discharge vessel has a third cavity extending to said remote side of said discharge vessel and separated from said first and second cavities;

a connection conductor connected to said second lamp contact extends through said third cavity and is connected to said second current supply conductor; an insulator surrounds said connection conductor over substantially the entire length of said discharge vessel and extends into said third cavity, said lamp having an electrically conductive path extending from said first lamp cap contact through said first current-supply conductor, through said discharge vessel across said electrodes to said second current-supply conductor, through said connection conductor surrounded by said insulator and through said third cavity to said second lamp cap contact, said fixation member and said clamping member being electrically isolated from said conductive path and non-current carrying during lamp operation; and said first tongues being welded to said clamping member.

2. A capped high-pressure discharge lamp as claimed in claim 1, characterized in that said second tongues are bent back alongside said fixation member at an acute angle therewith, said tongues being angled and having lengths chosen such that upon insertion of said fixation member into said annular cavity, said tongues flex inwardly towards said fixation member and said free ends biasably engage said outer wall of said annular cavity for securing said fixation member therein.

3. A capped high-pressure discharge lamp as claimed in claim 2, characterized in that said outer wall of said first, annular cavity comprises a plurality of discontinuities positioned to engage said free ends of said second tongues for restricting rotation of said fixation member in said lamp cap.

4. A capped high-pressure discharge lamp as claimed in claim 3, characterized in that said first cavity has a recess in which a third axially extending tongue of said fixation member is enclosed.

5. A capped high-pressure discharge lamp as claimed in claim 4, characterized in that said annular cavity has a reference surface, and said fixation member has at least one tag which is situated between two of said second tongues and which seats against said reference surface to axially position said discharge vessel with respect to said lamp cap.

6. A capped high-pressure discharge lamp as claimed in claim 3, characterized in that said clamping member is tubular and comprises a pair of tags at first and second adjoining circumferential portions thereof, which tags extend laterally to said discharge vessel and are welded together, and a resilient connection portion for maintaining said clamping force of said clamping member against said first sealed end portion of said discharge vessel.

7. A capped high-pressure discharge lamp as claimed in claim 6, characterized in that said tubular clamping member has said pair of tags (13) and said resilient connection portion at each of its two ends respectively.

8. A capped high-pressure discharge lamp as claimed in claim 1, characterized in that an insulated cable is mounted with electrical conduction to each of said lamp cap contacts.

9. A capped high-pressure discharge lamp as claimed in claim 8, characterized in that said remote side of said lamp cap facing away from said discharge vessel has a cover from which said cables extend to the exterior, said cover encloses a space with said lamp cap, and said space is filled with a synthetic material.

10. A capped high-pressure discharge lamp as claimed in claim 3, characterized in that said lamp cap has a screening cap of synthetic material at its side facing said discharge vessel covering said fixation and clamping members for screening said fixation and clamping members and substantially all of said synthetic lamp cap from radiation generated by said discharge vessel.

11. A capped high-pressure discharge lamp as claimed in claim 1, characterized in that said outer wall of said first, annular cavity comprises a plurality of discontinuities positioned to engage said free ends of said second tongues for restricting rotation of said fixation member.

12. A capped high-pressure discharge lamp as claimed in claim 11, characterized in that said first, annular cavity has a recess, and said fixation member has an axially extending third tongue enclosed in said recess for locking said fixation member against rotation in said lamp cap.

13. A capped high-pressure discharge lamp as claimed in claim 2, characterized in that said annular cavity has a reference surface, and said fixation member has at least one tag which is situated between two of said second tongues and which seats against said reference surface to axially position said arc tube with respect to said lamp cap.

14. A capped high-pressure discharge lamp as claimed in claim 1, characterized in that said annular cavity has a reference surface, and said fixation member has at least one tag which is situated between two of said second tongues and which seats against said reference surface to axially position said arc tube with respect to said lamp cap.

15. A capped high-pressure discharge lamp as claimed in claim 2, characterized in that said clamping member is tubular and comprises a pair of tags at first and second adjoining circumferential portions, which extend laterally to said discharge vessel and are welded together, and a resilient connection portion for maintaining said clamping force of said clamping member against said first sealed end portion of said discharge vessel.

16. A capped high-pressure discharge lamp as claimed in claim 15, characterized in that said tubular clamping member has said pair of tags and said resilient connection portion at each of its two ends respectively.

17. A capped high-pressure discharge lamp as claimed in claim 1, characterized in that said clamping member is tubular and comprises a pair of tags at first and second adjoining circumferential portions, which tags extend laterally to said discharge vessel and are welded together, and a resilient connection portion for maintaining said clamping force of said clamping member against said first sealed end portion of said discharge vessel.

18. A capped .high-pressure discharge lamp as claimed in claim 17, characterized in that said tubular clamping member has said pair of tags and said resilient connection portion at each of its two ends respectively.

19. A capped high-pressure discharge lamp as claimed in claim 1, characterized in that an insulated cable is mounted with electrical conduction to each of said lamp cap contacts.

20. A capped high-pressure discharge lamp as claimed in claim 19, characterized in that said remote side of said lamp cap facing away from said discharge vessel has a cover from which said cables issue to the exterior of said lamp cap, said cover encloses a space with said lamp cap, and said space is filled with a synthetic material.

21. A capped high-pressure discharge lamp as claimed in claim 2, characterized in that said lamp cap has a screening cap at its side facing said discharge vessel.

22. A capped high-pressure discharge lamp as claimed in claim 1, characterized in that said lamp cap has a screening cap at its side facing said discharge vessel.

23. A capped high pressure discharge lamp of the type having a discharge vessel energizeable for emitting light, said discharge vessel including an elongate end portion of vitreous material, a lamp cap of synthetic material, and a metallic clamping member holding said end portion and fixed in said lamp cap, said metal of said clamping member having a greater coefficient of thermal expansion than said end portion, wherein the improvement comprises:

said clamping member being tubular, cicumferentially surrounding said end portion with clamping force, having a pair of tags at first and second adjoining circumferential portions thereof, said tags extending laterally away from said end portion and being welded together, and a resilient connection portion extending laterally away from said end portion for compensating for the greater thermal expansion of said metal of said clamping member during lamp operation and maintaining said clamping force of said clamping member against said end portion.

24. A capped high pressure discharge lamp according to claim 23, wherein said clamping member has two opposing end portions each respectively comprising a pair of said welded tags and said resilient connection portion.

25. A capped high pressure discharge lamp of the type having a discharge vessel having an elongate end portion and being energizeable for emitting light, a metallic clamping member holding said end portion, a metallic fixation member fixed in said lamp cap and having tongues connected to said clamping member, and a lamp cap of synthetic material having a first, annular cavity with a cavity wall in which said fixation member is secured, and a second, central cavity into which said discharge vessel end portion extends, wherein the improvement comprises:

said fixation member has a cylindrical portion of reducible diameter which includes plurality of resilient second tongues, and a third tongue extending axially away from said discharge vessel, each second tongue including a resilient free arm extending generally in the axial direction towards said discharge vessel and forming an acute angle with said cylindrical portion for resiliently engaging said cavity wall;

said annular cavity has an end wall with a recess for receiving said third tongue, said recess having substantially radially extending side walls between inner and outer walls thereof which side walls narrow towards each other in the radially inward direction towards said central cavity; and said cylindrical portion of said fixation member having a first diameter selected such that upon insertion of said fixation member into said annular cavity and engagement of said second tongues with said cavity wall said third tongue is radially positioned near said outer wall of said recess when said third tongue enters said recess, upon further insertion into said cavity, said fixation member assuming a smaller diameter under the radial force of said resilient second tongues against said cavity wall and said third tongue moving radially inwards toward said inner recess wall and being clamped between said side walls for preventing rotation of said fixation member in said annular cavity, and said free arms of said second tongues engaging said cavity wall and securing said fixation member therein.

26. A capped high-pressure discharge lamp as claimed in claim 25, characterized int hat said annular cavity has a reference surface, and said fixation member has at least one tag which is situated between two of said second tongues and which seats against said reference surface to axially position said arc tube with respect to said lamp cap.

27. A capped high-pressure discharge lamp as claimed in claim 26, characterized in that said clamping member is tubular and comprises a pair of tags at first and second adjoining circumferential portions thereof, which extend laterally to said discharge vessel and are welded together, and a resilient connection portion for maintaining said clamping force of said clamping member against said end portion of said discharge vessel.

* * * * *